US005287699A

United States Patent [19]

Takamura et al.

[11] Patent Number: 5,287,699

[45] Date of Patent: Feb. 22, 1994

[54] AUTOMATIC VIBRATION METHOD AND DEVICE FOR HYDRAULIC DRILLING MACHINE

[75] Inventors: Fujitoshi Takamura, Hirakata; Takumi Onoda, Kawasaki, both of Japan

[73] Assignee: Kabushiki Kaisha Komatsu Seisakusho, Tokyo, Japan

[21] Appl. No.: 910,084

[22] PCT Filed: Jan. 16, 1990

[86] PCT No.: PCT/JP90/00039

§ 371 Date: Jul. 10, 1992

§ 102(e) Date: Jul. 10, 1992

[87] PCT Pub. No.: WO91/10783

PCT Pub. Date: Jul. 25, 1991

[51] Int. Cl.[5] ..... F16D 31/00; F16D 31/02

[52] U.S. Cl. ..... 60/327; 60/328; 60/469; 91/459; 91/517

[58] Field of Search ..... 60/327, 328, 420, 427, 60/469, 494; 91/459, 511, 517, 518

[56] References Cited

U.S. PATENT DOCUMENTS 4,689,955 9/1987 Lietzke ..... 60/420
4,708,596 11/1987 Palm et al. ..... 60/459 X
4,953,723 9/1990 Saotome ..... 60/469 X
4,969,562 11/1990 Saotome ..... 60/469 X
5,034,892 7/1991 Saotome ..... 60/469 X
5,048,296 9/1991 Sunamura et al. ..... 60/469 X

FOREIGN PATENT DOCUMENTS 59-68445 4/1984 Japan .
59-195938 11/1984 Japan .

*Primary Examiner*—Richard A. Bertsch
*Assistant Examiner*—Hoang Nguyen
*Attorney, Agent, or Firm*—Richards, Medlock & Andrews

[57] ABSTRACT

In a hydraulic drilling machine with a boom, arm and bucket as working parts, one or more of the working parts can be vibrated automatically to perform effective drilling with reduced resistance in various types of operations when the soil changes. Adequate vibration can be automatically generated by setting the working mode (Bo, A, Bu, Sk) and vibration mode (L, M, S) according to the soil or operation form beforehand and by setting the automatic vibration mode. Furthermore, since the control input of the working part lever can be added to the automatic vibration, simple and minute repeated operations, such as pressure-shifting, sifting or drilling conducted while the bucket is vibrated, can be performed readily and uniformly without exhausting the operator, and workability can thus be greatly improved.

20 Claims, 4 Drawing Sheets

AUTOMATIC VIBRATION METHOD AND DEVICE FOR HYDRAULIC DRILLING MACHINE

TECHNICAL FIELD

The present invention relates to an automatic vibration method and device for use in a hydraulic drilling machine with working parts consisting of a boom, an arm and a bucket, to apply adequate vibrations to the working parts and thereby achieve effective drilling with reduced resistance in various types of operations or even when the soil is changed.

BACKGROUND ART

Recent progress of the electronic technologies is remarkable. In the operation of hydraulic cylinders for the working parts of construction equipment, electronic hydraulic control has replaced mechanical control. In the structure shown in, for example, FIG. 5, a converter 52 converts the control input of a lever 51 operated by the operator into an electric signal, and inputs it to a controller 53. The controller 53 outputs an electric signal, proportional to the control input to a solenoid 55 or 56 of an electro-magnetic proportional valve 54. The electro-magnetic proportional valve 54 is opened proportionally to the electric signal, and an amount of oil proportional to the amount of the opening is supplied to a working part cylinder 61 via pipe 58 and either pipe 59 or pipe 60. The discharged oil from the working part cylinder 61 is returned to a tank 63 via a pipe 62.

However, the above-described conventional technique is performed manually, and therefore simple and minute repeated operations of the hydraulic drilling machine, such as pressure-shifting or sifting work, make the operator exhausted. Also, in pressure-shifting, sifting or drilling carried out while the bucket is vibrated in order to increase the drilling force, the electro-magnetic proportional valve 54 must be activated at a very high speed. However, in an electro-magnetic proportional valve having a large capacity, the force of inertia is large and there is a limit to increasing the switching speed. Consequently, it is impossible to apply adequate vibration to the bucket to cope with changes in the operation form or the soil.

In view of the aforementioned problems, an object of the present invention is to provide an automatic vibration method and device for a hydraulic drilling machine which are capable of effective drilling by reducing the resistance to coping with various types of operations or changes in the soil.

SUMMARY OF INVENTION

The present invention provides an automatic vibration method for a hydraulic drilling machine which comprises a working mode in which a vibration signal for at least one working part selected from a boom, an arm and a bucket is selected from a memory according to an operation form, a vibration mode in which an amplitude and a frequency of the selected vibration signal are selected from the memory according to the operation form, and an automatic vibration mode in which the vibration signal selected by the working mode and the vibration mode is outputted to an electronic hydraulic valve of an actuator of the working part. An operation signal corresponding to a control input of a working part lever is added to the vibration signal selected from the memory by the working mode and the vibration mode. The present invention also provides an automatic vibration device for a hydraulic drilling machine which comprises a working mode switch for selecting a vibration signal for at least one working part selected from a boom, an arm and a bucket from a memory according to an operation form, a vibration mode switch for selecting an amplitude and a frequency of the selected vibration signal from the memory according to the operation form, and an automatic vibration mode switch for outputting the vibration signal selected by the working mode and the vibration mode to an electronic hydraulic valve of an actuator of the working part. The automatic vibration device for the hydraulic drilling machine further includes an addition circuit for adding an operation signal corresponding to a control input of a working part lever to the vibration signal selected from the memory by the working mode switch and the vibration mode switch. In the above-described structure, when the operator selects the vibration signal for at least one working part from the memory by using the working mode switch, and selects the amplitude and frequency of the vibration signal from the memory by using the vibration mode switch, and selects the automatic vibration mode by using the automatic vibration mode switch, and then inputs the vibration signal to the electronic hydraulic valve of the working part actuator, the selected working part can be automatically vibrated at the selected amplitude and frequency. Furthermore, since the operation signal corresponding to the control input of the working part lever which is operated by the operator is added to the vibration signal by the addition circuit, the selected working part can be vibrated similarly using the obtained vibration signal.

Thus, adequate vibration can be automatically generated by setting the working mode and vibration mode according to the soil or operation form beforehand and by setting the automatic vibration mode. Furthermore, since the control input of the working part lever can be added to the vibration, simple and minute repeated operations, such as pressure-shifting, sifting or drilling conducted while the bucket is vibrated, can be performed readily and uniformly without exhausting the operator, and workability can thus be greatly improved.

BEST MODE FOR CARRYING OUT THE INVENTION

Figure 1:
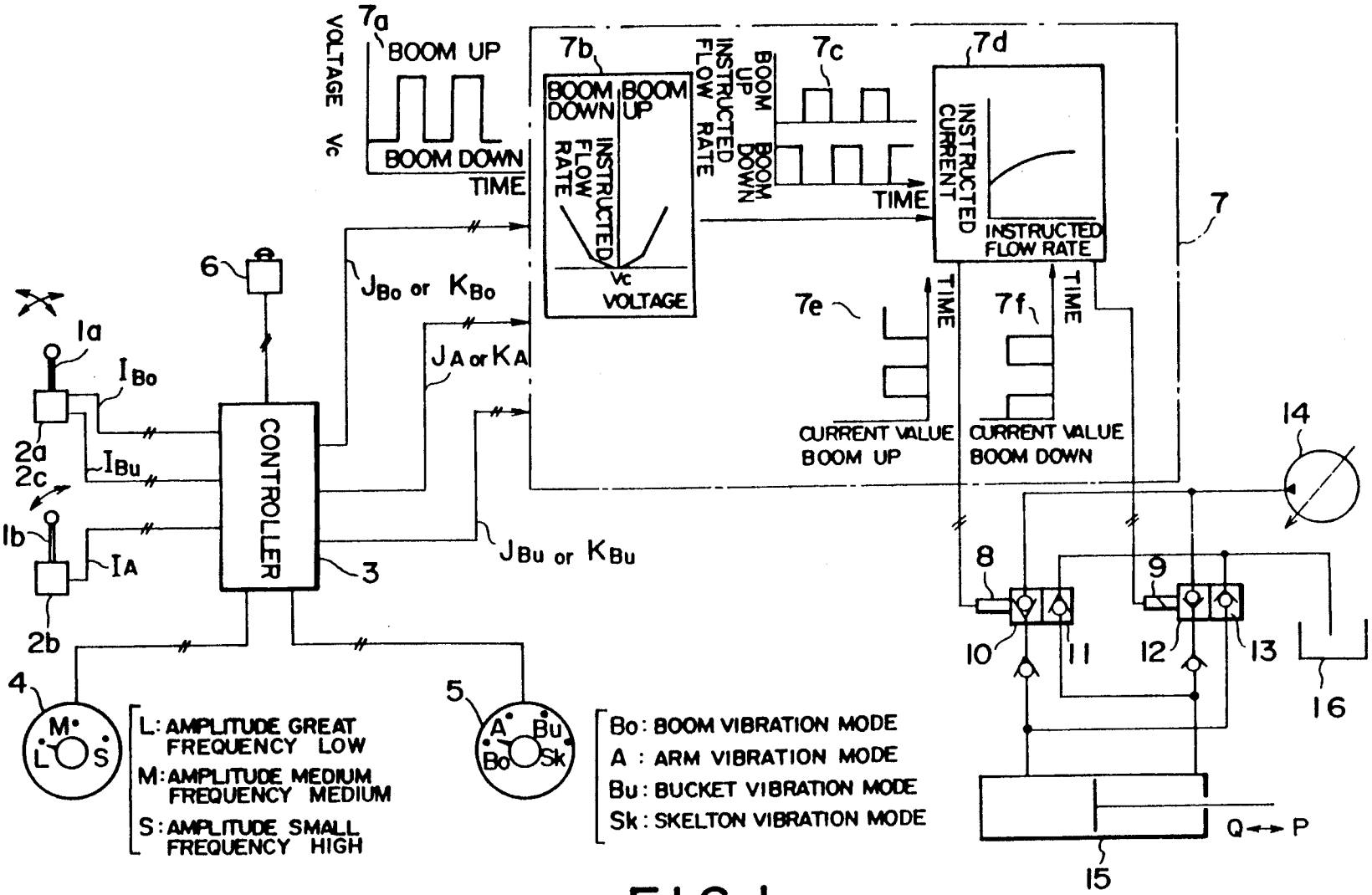
FIG. 1 is an electric and hydraulic circuit diagram of an automatic vibrating device for a working part according to an embodiment of the present invention.

FIG. 1 is an electric and hydraulic circuit diagram of a working part automatic vibrating device according to an embodiment of the present invention. In FIG. 1, reference characters 1*a* and 1*b* denote right and left working parts levers. 2*a*, 2*b* and 2*c* denote devices for converting the control inputs of the working parts levers 1*a* and 1*b* into electrical signals. 3 denotes an automation controller with a vibration mode/work mode memory to be selected by electric signals respectively designated by a vibration mode switch 4 and a work mode switch 5 incorporated therein. When an automatic vibration mode switch 6 is turned to the automatic position after the vibration mode/work mode memory has been selected, a vibration signal of the selected vibration mode/work mode is inputted to an electronic controller 7.

That is, in the vibration mode switch 4, either the L mode: large amplitude/low frequency, the M mode: intermediate amplitude/intermediate frequency or the S mode: small amplitude/high frequency is selected from the memory as the vibration mode. In the work mode switch 5, the Bo mode: boom vibrated, the A mode: arm vibrated, the Bu mode: bucket vibrated or the Sk mode: arm and bucket vibrated simultaneously (hereinafter referred to as a skeleton vibration) is selected from the memory as the work mode. The vibration signals of the selected vibration mode/work mode are outputted from the automation controller to the electronic controller 7 in the form of pulsed voltage signals $J_{Bo}$, $J_A$, and $J_{Bu}$. In the controller 7, for example, the boom voltage signal $J_{Bo}$ and the command flow rate to a boom cylinder 15 have a relation *7b*. The command flow rate of the boom voltage signal changes with time in the manner *7c*. The command flow rate of the boom voltage signal and a current signal have a relation *7d*. Thus, the boom voltage signal $J_{Bo}$ is outputted from the controller 7 to a solenoid 8 or 9 of electronic hydraulic valves 10 and 11 or 12 and 13 in the form of current signals *7e* and *7f*.

The thus-arranged automatic vibration device is operated in the manner described below. When the automatic vibration mode switch 6 is turned to the manual position and the work mode switch 5 is set to the Bo mode while the vibration mode switch 4 is set to the L mode, the controller 3 outputs a pulsed voltage signal such as that indicated by *7a* to the electronic controller 7 as the boom voltage signal $J_{Bo}$. The controller 7 converts the voltage signal $J_{Bo}$ into a boom raising current signal or a boom lowering current signal indicated by *7e* and *7f* and outputs the same to the solenoid 8 or 9 of the electronic hydraulic valves 10 and 11 or 12 and 13. When the boom raising current signal *7e* is inputted to the solenoid 8, poppet valves 10 and 11 are opened according to the signal, and the amount of pressure oil corresponding to the amount of opening of the poppet valves is discharged from a hydraulic pump 14 and is supplied through valve 10 to a bottom chamber of the boom cylinder 15, moving a piston rod in the direction indicated by an arrow P. Concurrently with this, the pressure oil discharged from a rod chamber of front cylinder 15 returns through valve 11 to a tank 16. When the boom lowering current signal *7f* is inputted from the electronic controller 7 to the solenoid 9, poppet valves 12 and 13 are opened according to the signal, and the amount of pressure oil discharged from the hydraulic pump 14 according to the amount of opening is supplied through valve 12 to the rod chamber of the boom cylinder 15 while the pressure oil is discharged from the bottom chamber of boom cylinder 15 through valve 13 to the tank 16, moving the piston rod in the direction indicated by an arrow Q. Thus, the piston rod of the boom cylinder 15 is moved back and forth in the P and Q directions in the L mode. Since there are four work modes Bo, A, Bu and Sk and three vibration modes L, M and S, twelve types of operation forms can be carried out in total. In FIG. 1, only the operation of the boom cylinder 15 has been illustrated. The other working cylinders are operated in the same manner, and description thereof is omitted.

Figure 2:
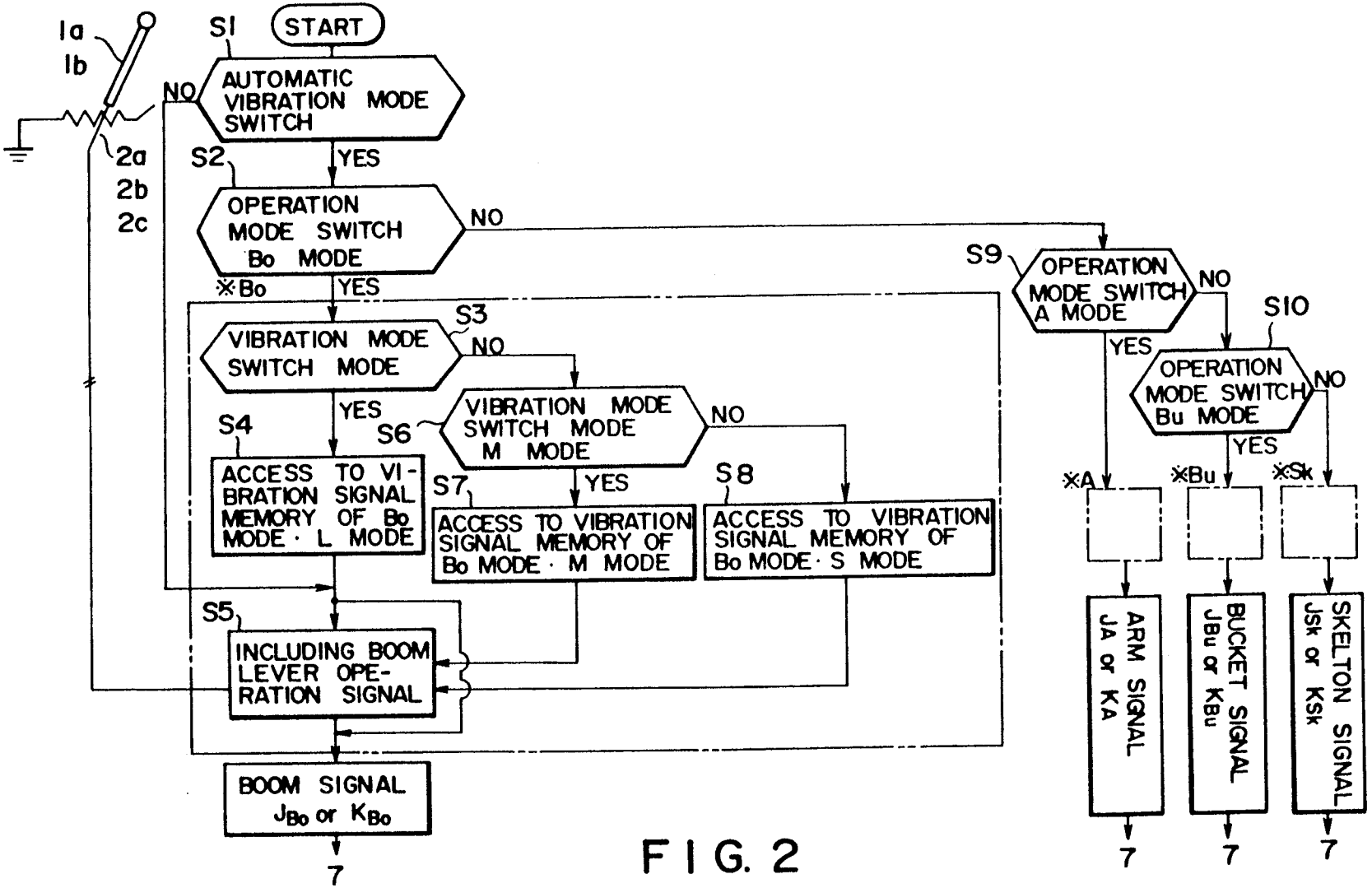
FIG. 2 is a flowchart of an automatic vibrating method for a working part according to an embodiment of the present invention.

FIG. 2 is a flowchart of the automatic vibration method according to the embodiment of the present invention. After the automatic vibration method has been started, the automatic vibration mode switch 6 is turned to the automatic position in step S1. If the working mode switch 5 is set to the Bo mode in step S2, the process goes to step S3. If the vibration mode switch 4 is set to the L mode in step S3, the vibration signal memory for the Bo mode and L mode is written out in step S4. The vibration signal read out from the memory is inputted to the electronic controller 7 as the boom voltage signal $J_{Bo}$. If the operator operates the working part lever 1*a*, the control input of the lever 1*a* is converted into a boom lever operation signal $I_{Bo}$ by the electric signal converting device 2*a*, and the converted signal $I_{Bo}$ is added to the vibration signal memory in step S5. The obtained vibration signal is inputted to the electronic controller 7 as a pulsed boom voltage signal $J_{Bo}$ or $K_{Bo}$. The electronic controller 7 converts the boom voltage signal $K_{Bo}$ into a current signal and inputs it to the solenoid 8 or 9.

If the working mode switch 5 is set to the A mode in step S2 shown in FIG. 2, the process proceeds from steps S1 and S2 to step S9, and an arm voltage signal $J_A$ or $K_A$ is outputted via the process enclosed by a frame indicated by *A which contains similar steps to that of the L mode described in a frame indicated by *Bo to perform vibration of the arm in the same manner as the boom. If the working mode switch 5 is set to the Bu mode, the process goes from steps S1, S2 and S9 to step S10, and a bucket voltage signal $J_{Bu}$ or $K_{Bu}$ is outputted Via the process enclosed by a frame indicated by *Bu which contains similar steps to that of the L mode described in the frame indicated by *Bo to perform vibration of the bucket. If the working mode switch 5 is set to the Sk mode, the process passes through step S1, S2, S9, and S10 and a skeleton voltage signal $J_{sk}$ or $K_{sk}$ is outputted via the process enclosed by a frame indicated by *Sk which contains similar steps to that of the L mode described in the frame indicated by *Bo to perform skeleton vibration. Skeleton work originating from sifting the soil in a skeleton-shaped bucket indicates the operation in which both the arm and the bucket are activated at the same time.

Figure 3:
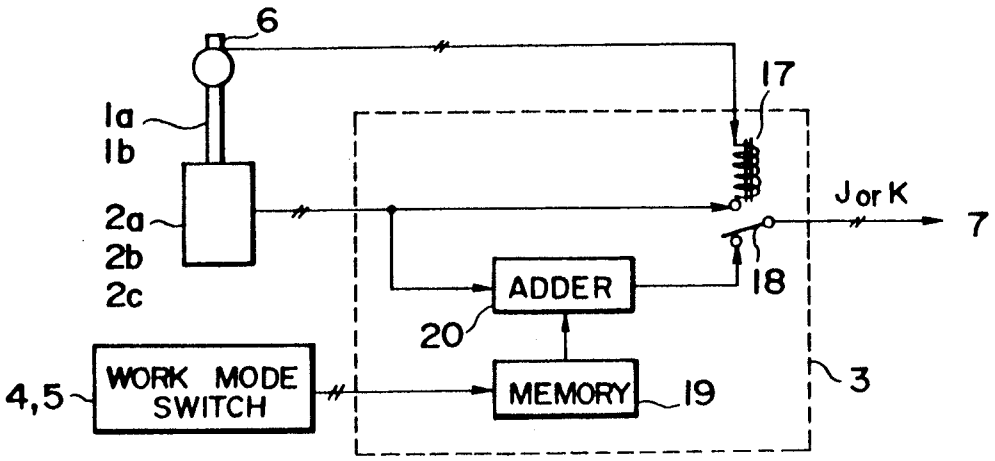
FIG. 3 illustrates an automation controller shown in FIG. 1.

FIG. 3 illustrates details of the automation controller 3 shown in FIG. 1. When the automatic vibration mode switch 6 is turned to the manual position, a switch 18 is attracted to a magnet 17 to provide the manual mode. Turning the automatic vibration mode switch 6 to the automatic position makes the switch 18 separate from the magnet 17 and thus provides the automatic vibration mode in which the vibration signal corresponding to the modes set by the vibration mode switch 4 and the working mode switch 5 is outputted from a memory 19. The output vibration signal is inputted to the electronic controller 7 as the pulsed voltage signal J. If the operator operates the working part lever 1*a* or 1*b*, the control input of the lever is converted into an electric signal by the electric signal converter 2*a*, 2*b* or 2*c*, and the converted electric signal is added to the vibration signal by adder 20. The vibration signal obtained by an addition circuit of adder 20 as a result of addition is inputted to the electronic controller 7 as the pulsed voltage signal K.

Figure 4:
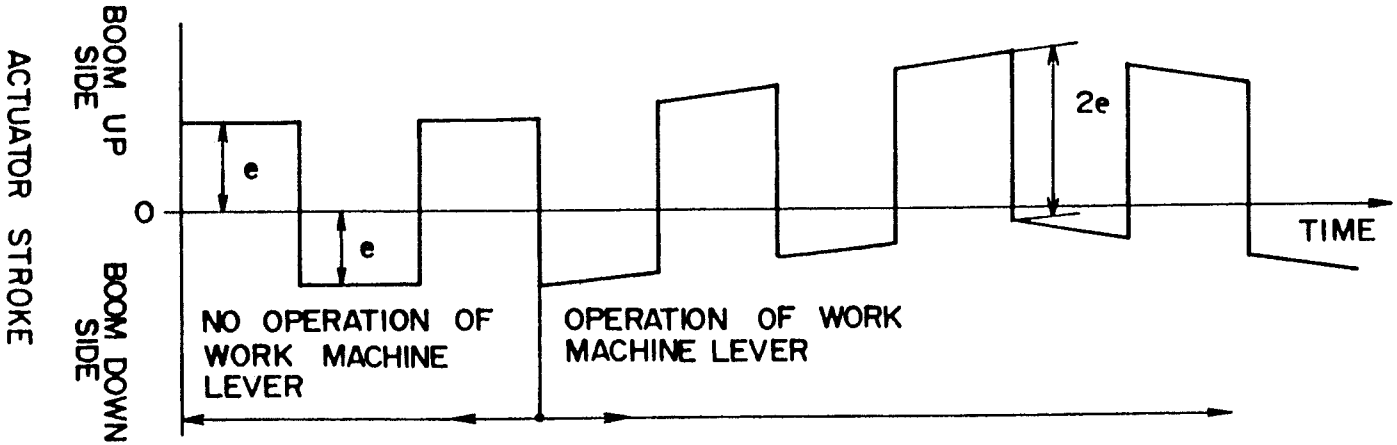
FIG. 4 illustrates the operation of an actuator according to the embodiment of the present invention.
Figure 5:
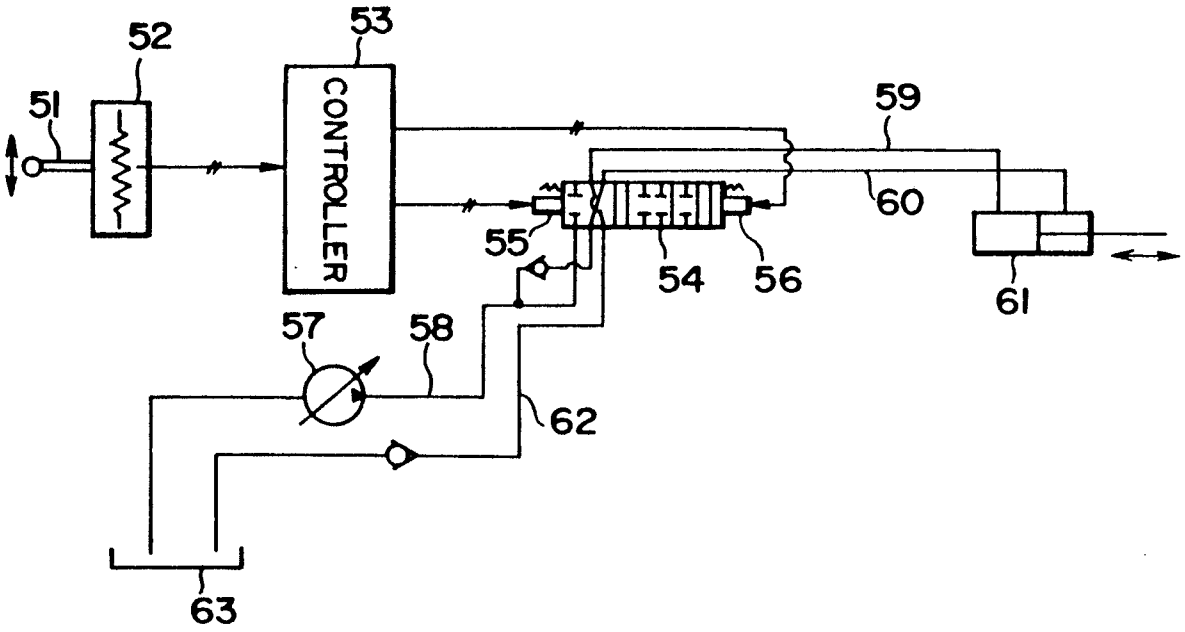
FIG. 5 (PRIOR ART)
FIG. 5 is a conventional electric and hydraulic circuit diagram.

FIG. 4 illustrates the operation of an actuator according to the embodiment of the present invention. The ordinate axis represents the stroke (amplitude) of the actuator, and the abscissa axis represents the time (frequency). While the working part lever 1*a* or 1*b* is not operated, the actuator is pulse vibrating at a fixed amplitude (e) and a fixed frequency. When the working part lever 1*a* or 1*b* is operated, the reference level of the pulses varies with the control input of the levers added thereto. In the case of the actuator for the boom cylinder, when raising and lowering operations of the boom are performed, the boom rises and lowers with the same peak-to-peak amplitude (2*e*).

INDUSTRIAL APPLICABILITY

The automatic vibration method and device according to the present invention are employed in a hydraulic drilling machine with working parts consisting of a boom, arm and bucket and are particularly advantageous in pressure-shifting, sifting or drilling carried out while the bucket is vibrated in order to increase the drilling force.

What is claimed is:

1. An automatic vibration method for operating a hydraulic drilling machine having working parts comprising a boom, an arm and a bucket, said method comprising:

the step of selecting, from a memory according to an operation form, a vibration signal for at least one of said working parts selected from the boom, the arm and the bucket;

the step of selecting, from the memory according to the operation form, an amplitude and a frequency of the selected vibration signal; and the step of outputting, to an electronic hydraulic valve of an actuator of the working part, the vibration signal selected by said step of selecting a vibration signal and said step of selecting an amplitude and a frequency of the selected vibration signal.

2. An automatic vibration method for operating a hydraulic drilling machine according to claim 1, further comprising adding an operation signal corresponding to a control input of a working part lever to the vibration signal selected from the memoyr by said step of selecting a vibration signal and said step of selecting an amplitude and a frequency of the selected vibration signal.

3. An automatic vibration device for a hydraulic drilling machine with working parts comprising a boom, an arm and a bucket, said device comprising:

a working mode switch for selecting a vibration signal for the at least one working part selected from the boom, the arm and the bucket from a memory according to an operation form;

a vibration mode switch for selecting an amplitude and a frequency of the selected vibration signal from the memory according to the operation form; and an automatic vibration mode switch for outputting the vibration signal, selected by the working mode switch and the vibration mode switch, to an electronic hydraulic valve of an actuator of the working part.

4. An automatic vibration device for a hydraulic drilling machine according to claim 3, further comprising an addition circuit for adding an operation signal corresponding to a control input of a working part lever to the vibration signal selected from the memory by the working mode switch and the vibration mode switch.

5. A method for operating a hydraulic drilling machine having a boom, an arm and a bucket as working parts, said method comprising:

selecting a vibration signal for at least one of said working parts from a memory according to an operation form;

selecting an amplitude and a frequency for the thus selected vibration signal from said memory according to said operation form;

establishing an output signal responsive to the thus selected vibration signal having the thus selected amplitude and frequency; and controlling an actuator for said at least one of said working parts responsive to said output signal to thereby vibrate said at least one of said working parts.

6. A method in accordance with claim 5 further comprising establishing an operation signal responsive to the manual actuation of a control lever for said at least one of said working parts, and wherein said output signal is established responsive to said operation signal and to said thus selected vibration signal having the thus selected amplitude and frequency.

7. A method in accordance with claim 6 wherein said at least one of said working parts is said boom.

8. A method in accordance with claim 6 wherein said at least one of said working parts is said arm.

9. A method in accordance with claim 6 wherein said at least one of said working parts is said bucket.

10. A method in accordance with claim 6 wherein said at least one of said working parts is said arm and said bucket such that said arm and said bucket are vibrated simultaneously.

11. A control system for use with a hydraulic drilling machine having a boom, an arm and a bucket as working parts, wherein each of said working parts has at least one hydraulic cylinder for actuating the respective working part, said control system comprising:

a controller for producing an output signal, said controller having a memory for storing vibration signals for each of said working parts according to an operation form and for storing amplitudes and frequencies for each of said vibration signals according to said operation form;

a work mode switch connected to said controller for selecting at least one of said working parts to be vibrated;

a vibration mode switch connected to said controller for selecting an amplitude and a frequency;

wherein said controller selects from said memory a stored vibration signal for the working part selected by said work mode switch and selects from said memory an amplitude and a frequency in response to the selection indicated by said vibration mode switch and establishes said output signal in response to the thus selected stored vibration signal and the thus selected amplitude and frequency; and means for applying said output signal to at least one actuator for the working part selected by said work mode switch, to thereby effect vibration of the thus selected working part.

12. A control system in accordance with claim 11 further comprising at least one manually operable lever for controlling at least one of said working parts, means responsive to the actuation of said lever for establishing an operation signal for said at least one of said working parts, and wherein said controller establishes said output signal responsive to said operation signal and to said thus selected stored vibration signal and said thus selected amplitude and frequency.

13. A control system in accordance with claim 12 further comprising an automatic vibration mode switch for selecting a manual operation mode wherein said output signal is established responsive to said operation signal without being responsive to said thus selected stored vibration signal and said thus selected amplitude and frequency, and an automatic operation mode wherein said output signal is established responsive to said operation signal and to said thus selected stored vibration signal and the thus selected amplitude and frequency.

14. A hydraulic drilling machine having a boom, an arm and a bucket as working parts, wherein each of said working parts has at least one hydraulic cylinder for actuating the respective working part, and wherein said hydraulic drilling machine further comprises a control system in accordance with claim 13.

15. A hydraulic drilling machine having a boom, an arm and a bucket as working parts, wherein each of said working parts has at least one hydraulic cylinder for actuating the respective working part, and wherein said hydraulic drilling machine further comprises a control system in accordance with claim 11.

16. A hydraulic drilling machine in accordance with claim 15 wherein said control system further comprises at least one manually operable lever for controlling at least one of said working parts, means responsive to the actuation of said lever for establishing an operation signal for said at least one of said working parts, and wherein said controller establishes said output signal responsive to said operation signal and to said thus selected stored vibration signal and the thus selected amplitude and frequency.

17. A hydraulic drilling machine in accordance with claim 16 wherein said at least one of said working parts is said boom.

18. A hydraulic drilling machine in accordance with claim 16 wherein said at least one of said working parts is said arm.

19. A hydraulic drilling machine in accordance with claim 16 wherein said at least one of said working parts is said bucket.

20. A hydraulic drilling machine in accordance with claim 16 wherein said at least one of said working parts is said arm and said bucket such that said arm and said bucket are vibrated simultaneously.

* * * * *